US008902026B2

(12) United States Patent
Fujita et al.

(10) Patent No.: US 8,902,026 B2
(45) Date of Patent: Dec. 2, 2014

(54) ELECTRIC CURRENT SWITCHING APPARATUS

(75) Inventors: Daisuke Fujita, Tokyo (JP); Hironori Kashiwagi, Tokyo (JP); Shinichiro Nakauchi, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 0 days.

(21) Appl. No.: 13/519,506

(22) PCT Filed: Jul. 9, 2010

(86) PCT No.: PCT/JP2010/061721
§ 371 (c)(1),
(2), (4) Date: Jun. 27, 2012

(87) PCT Pub. No.: WO2011/104902
PCT Pub. Date: Sep. 1, 2011

(65) Prior Publication Data

US 2012/0280772 A1 Nov. 8, 2012

(30) Foreign Application Priority Data

Feb. 26, 2010 (WO) ..... PCT/JP2010/053160

(51) Int. Cl.
*H01H 9/30* (2006.01)
*H01H 9/44* (2006.01)
*H01H 33/18* (2006.01)
*H01H 1/38* (2006.01)

(52) U.S. Cl.
CPC ..... *H01H 33/182* (2013.01); *H01H 1/385* (2013.01)
USPC ..... 335/201; 218/22; 218/23; 218/24; 218/25; 218/26; 218/27; 218/28

(58) Field of Classification Search
CPC ..... H01H 9/30; H01H 9/44; H01H 9/443; H01H 9/446; H01H 73/18
USPC ..... 335/201; 218/22–28
See application file for complete search history.

(56) References Cited

U.S. PATENT DOCUMENTS 3,376,401 A * 4/1968 Bazi et al. ..... 218/23
3,384,772 A * 5/1968 Rabinowitz ..... 313/147

(Continued)

FOREIGN PATENT DOCUMENTS

EP 78719 A1 * 5/1983
JP 49-45231 Y1 12/1974

(Continued)

OTHER PUBLICATIONS

International Search Report (PCT/ISA/210) issued on Aug. 3, 2010, by the Japanese Patent Office as the International Searching Authority for International Application No. PCT/JP2010/061721.

(Continued)

*Primary Examiner* — Mohamad Musleh
(74) *Attorney, Agent, or Firm* — Buchanan Ingersoll & Rooney PC

(57) ABSTRACT

To provide an electric current switching apparatus having a fixed-side electrode unit and a movable-side electrode unit that are arranged to align central axes thereof with each other and to face each other, in which a movable contact provided in the movable-side electrode unit reciprocates on the central axis to contact or separate from a fixed-side contact provided in the fixed-side electrode unit, thereby switching electric current flowing through these electrode units, the electric current switching apparatus including a plurality of permanent magnets that are provided in at least one of the fixed-side electrode unit and the movable-side electrode unit, that have bodies arranged on the central axis to align magnetizing directions thereof with the central axis, and that are arranged to cause same poles of adjacent ones of the permanent magnets to face each other as if butting with each other.

10 Claims, 10 Drawing Sheets

(56) References Cited

U.S. PATENT DOCUMENTS

| | | | | | |
|---|---|---|---|---|---|
| 4,273,977 | A | * | 6/1981 | Kii | 218/28 |
| 4,560,848 | A | * | 12/1985 | Arimoto | 218/23 |
| 5,837,953 | A | * | 11/1998 | Ito et al. | 218/30 |
| 7,999,202 | B2 | | 8/2011 | Fujita et al. | |
| 8,274,007 | B2 | * | 9/2012 | Blalock et al. | 218/129 |
| 2011/0124245 | A1 | | 5/2011 | Fujita et al. | |

FOREIGN PATENT DOCUMENTS

| | | | | |
|---|---|---|---|---|
| JP | 57-63733 | A | | 4/1982 |
| JP | 58-184720 | U | | 12/1983 |
| JP | 62254328 | A | * | 11/1987 |
| JP | 02021522 | A | * | 1/1990 |
| JP | 2000-011820 | A | | 1/2000 |
| JP | 2002-197949 | A | | 7/2002 |
| JP | 2003-346611 | A | | 12/2003 |
| JP | 2004-236459 | A | | 8/2004 |
| JP | 2007-335148 | A | | 12/2007 |
| JP | 2007323992 | A | * | 12/2007 |
| JP | 4212645 | B1 | | 11/2008 |
| WO | WO 2009/128134 | A1 | | 10/2009 |

OTHER PUBLICATIONS

Written Opinion (PCT/ISA/237) issued on Aug. 3, 2010, by the Japanese Patent Office as the International Searching Authority for International Application No. PCT/JP2010/061721.

May 12, 2014 Chinese Office Action issued in Chinese Patent Application No. 201080064673.3. (with English language translation).

* cited by examiner

ELECTRIC CURRENT SWITCHING APPARATUS

FIELD

The present invention relates to an electric current switching apparatus that performs switching of electric current, and more particularly to an electric current switching apparatus that is arranged in a gas insulated switchgear.

BACKGROUND

In a gas insulated switchgear, insulating gas such as $SF_6$ (sulfur hexafluoride) gas is filled in a metallic container and an electric current switching apparatus such as a circuit breaker is arranged therein.

In recent years, lowering in a gas pressure of the $SF_6$ gas or degassing of the $SF_6$ gas has been demanded to reduce environmental loads. However, the lowering in the gas pressure or the degassing degrades an electric current switching performance of the electric current switching apparatus and thus an improvement measure for compensation is required.

Furthermore, a capacity of the gas insulated switchgear has recently been more increased and enhancement of the electric current switching performance corresponding thereto has also been demanded.

Patent Literature 1 describes a gas insulated switching apparatus that rotationally drives an arc by using a magnetic field of a permanent magnet, thereby cooling and interrupting the arc, for the purpose of improving an interruption performance. FIG. 11 in Patent Literature 1 depicts a configuration in which a single permanent magnet is arranged within a fixed-side arcing contact.

CITATION LIST

Patent Literatures

Patent Literature 1: Japanese Patent Application Laid-open No. 2003-346611

Patent Literature 2: Japanese Patent No. 4212645

SUMMARY

Technical Problem

However, in the conventional technology that enables to rotationally drive the arc by using the single permanent magnet, the interruption performance is not sufficiently high, resulting in difficulty in prompt extinction of the arc, when current specifications are high, for example.

The present invention has been achieved in view of the above problem, and an object of the present invention is to provide an electric current switching apparatus that enables to greatly enhance the electric current switching performance.

Solution to Problem

In order to solve above-mentioned problems and achieve the object, according to an aspect of the present invention, there is provided an electric current switching apparatus having a fixed-side electrode unit and a movable-side electrode unit that are arranged to align central axes thereof with each other and to face each other, in which a movable contact provided in the movable-side electrode unit reciprocates on the central axis to contact or separate from a fixed-side contact provided in the fixed-side electrode unit, thereby switching electric current flowing between the fixed-side electrode unit and the movable-side electrode unit, the electric current switching apparatus comprising a plurality of permanent magnets that are provided in at least one of the fixed-side electrode unit and the movable-side electrode unit, are arranged to have magnetizing directions thereof aligned with a direction of the central axis, are arranged within a cylindrical area having a radius defined by an outer diameter of the movable contact around the central axis, and are arranged to cause same poles of adjacent ones of the permanent magnets to face each other as if butting with each other.

According to another aspect of the present invention, there is provided an electric current switching apparatus having a fixed-side electrode unit and a movable-side electrode unit that are arranged to align central axes thereof with each other and to face each other, in which a movable contact provided in the movable-side electrode unit reciprocates on the central axis to contact or separate from a fixed-side contact provided in the fixed-side electrode unit, thereby switching electric current flowing between the fixed-side electrode unit and the movable-side electrode unit, the electric current switching apparatus comprising: a fixed-side shield arranged around the fixed-side contact; a movable-side shield arranged around the movable contact; and a plurality of permanent magnets that are provided within at least one of the fixed-side shield and the movable-side shield, are arranged to have magnetizing directions thereof aligned with a direction of the central axis, are arranged outside of a cylindrical area having a radius defined by an outside diameter of the movable contact around the central axis, and are arranged to cause same poles of adjacent ones of the permanent magnets to face each other as if butting with each other.

Advantageous Effects of Invention

According to the present invention, significant enhancement in the electric current switching performance can be achieved.

DESCRIPTION OF EMBODIMENTS

Exemplary embodiments of an electric current switching apparatus according to the present invention will be explained below in detail with reference to the accompanying drawings. The present invention is not limited to the embodiments.

First Embodiment

Figure 1:
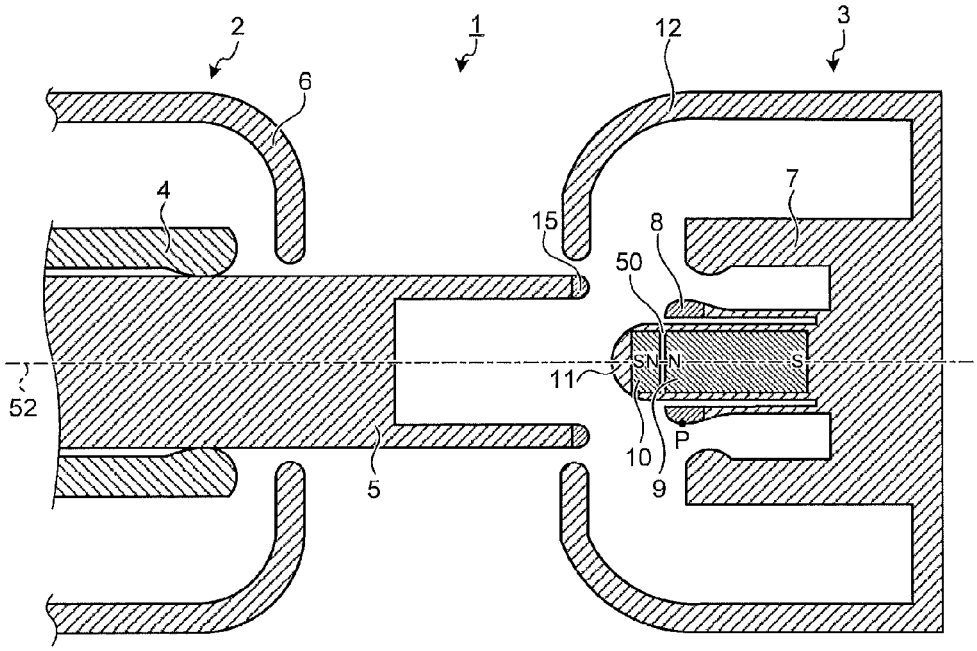
FIG. 1 depicts a cross-sectional configuration of an electric current switching apparatus according to a first embodiment.

FIG. 1 depicts a cross-sectional configuration of an electric current switching apparatus 1 according to a first embodiment of the present invention. The electric current switching apparatus 1 is, for example, a circuit breaker placed in a gas insulated switchgear, a disconnector with electric current switching specifications, or a grounding switch with electric current switching specifications. FIG. 1 depicts a cross-sectional configuration of an electric current switching unit thereof.

The electric current switching apparatus 1 is arranged in a metallic container (not shown) having insulating gas such as $SF_6$ filled therein. The electric current switching apparatus 1 includes a movable-side electrode unit 2 and a fixed-side electrode unit 3 that are placed to face each other.

The movable-side electrode unit 2 includes a movable-side main contact 4 formed in a tubular shape, a movable contact 5 that contacts the movable-side main contact 4 and is formed in a tubular shape to enable a reciprocating movement in a central axis direction thereof, a movable-side arcing contact 15 that is provided in a tubular shape at an end of the movable contact 5 and is made of an arc-resistant material, and a movable-side shield 6 for electric field relaxation that is provided around the movable-side main contact 4. In this case, the arc-resistant material is a metallic material having resistance to wear caused by an arc.

The central axis of the tubular movable contact 5 is hereinafter referred to as a central axis of the movable-side electrode unit 2. The central axis direction of the movable-side electrode unit 2 is a direction of the reciprocating movement of the movable contact 5 and is a direction of switching of the electric current switching apparatus 1. The movable contact 5 is connected to a driving mechanism (not shown) and is linearly reciprocated by the driving mechanism.

The fixed-side electrode unit 3 includes a fixed-side main contact 7 formed in a tubular shape, a tubular fixed-side arcing contact 8 that is provided within the fixed-side main contact 7 to constitute a fixed-side contact together with the fixed-side main contact 7 and is made of an arc-resistant material, permanent magnets 9 and 10 arranged within the fixed-side arcing contact 8, and a fixed-side shield 12 for electric field relaxation that is provided around the fixed-side main contact 7.

The fixed-side arcing contact 8 is coaxially arranged within the fixed-side main contact 7. That is, the fixed-side main contact 7 and the fixed-side arcing contact 8 have the same central axis. The central axis of the fixed-side main contact 7 is hereinafter referred to as a central axis of the fixed-side electrode unit 3. The movable-side electrode unit 2 has the same central axis as that of the fixed-side electrode unit 3 (a central axis 52 in FIG. 1). The movable contact 5 moves forward and backward in a space between the fixed-side main contact 7 and the fixed-side arcing contact 8 to contact and separate from the fixed-side main contact 7 and the fixed-side arcing contact 8, thereby switching current flowing between the electrode units.

The permanent magnets 9 and 10 are arranged, for example, on the central axis of the fixed-side electrode unit 3. These permanent magnets are arranged to align magnetizing directions thereof with the central axis direction and closely arranged in such a manner that same poles thereof face each other. Specifically, an end surface on an N-pole side of the permanent magnet 9 and an end surface on an N-pole side of the permanent magnet 10 are arranged face-to-face on the central axis 52 in the same line. Alternatively, a configuration in which an end surface on an S-pole side of the permanent magnet 9 and an end surface on an S-pole side of the permanent magnet 10 are arranged face-to-face is possible. The number of permanent magnets arranged in the central axis direction is not limited to two as in the example shown in FIG. 1 but it generally suffices to arrange plural permanent magnets. In such cases, the plural permanent magnets are arranged to place same poles of adjacent permanent magnets face-to-face. The configuration in which the number of permanent magnets is two is the most compact one.

The permanent magnets 9 and 10 can have pillar shapes, for example. In FIG. 1, the permanent magnets 9 and 10 have circular pillar shapes, for example. Because these are versatile shapes and the gas insulated switchgear basically has a coaxial cylinder shape, the permanent magnets 9 and 10 in the circular pillar shapes are suitable for installation in the electrode unit. Alternatively, rectangular pillar shapes can be adopted as the pillar shapes, for example.

The permanent magnets 9 and 10 can have the same diameter, for example. That is, cross-sections of the permanent magnets 9 and 10 can be equal in size to each other. When the permanent magnets 9 and 10 have the same diameter, their installations in the electrode unit becomes easier.

In the example shown in FIG. 1, a thickness in the central axis direction of the permanent magnet 9 is larger than that in the central axis direction of the permanent magnet 10.

The permanent magnets 9 and 10 are placed in a space formed within the fixed-side arcing contact 8 and are covered with a case 11 made of a member such as metal and fixed to the fixed-side electrode unit 3.

Materials of the permanent magnets 9 and 10 can be one including a rare earth such as neodymium or samarium-cobalt, or a versatile material such as ferrite or alnico.

Figure 2:
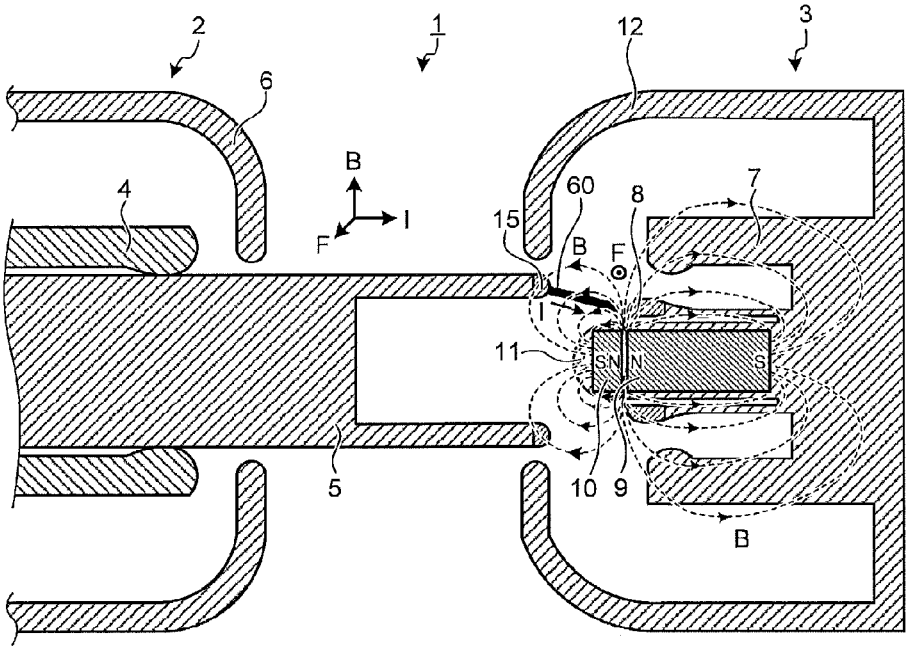
FIG. 2 is an explanatory diagram of an effect of permanent magnets provided in a fixed-side electrode unit in the first embodiment.

FIG. 2 is an explanatory diagram of an effect of the permanent magnets 9 and 10 provided in the fixed-side electrode unit 3. FIG. 2 depicts a state immediately after interruption during an opening operation of the electric current switching apparatus 1, in which an arc 60 occurs between the fixed-side arcing contact 8 and the movable-side arcing contact 15. Magnetic fluxes generated from the permanent magnets 9 and 10 are denoted by dotted lines including arrows. In FIG. 2, constituent elements identical to those shown in FIG. 1 are denoted by like reference signs.

As shown in FIG. 2, an arc current I flows between the fixed-side arcing contact 8 and the movable-side arcing contact 15 with occurrence of the arc 60. Due to a magnetic flux density B generated from the permanent magnets 9 and 10, the current I is subject to a Lorentz force F in a direction perpendicular to the current I and the magnetic flux density B. Because the arc current I flows substantially in the central axis direction as shown in FIG. 2, the current I is subject to the Lorentz force F due to a radial component among components of the magnetic flux density B, whereby the arc 60 is rotationally driven around the central axis. In this case, the radial direction is perpendicular to the central axis direction. Therefore, when the radial component of the magnetic flux density B is increased, the rotational driving of the arc 60 is enhanced and the arc 60 is effectively cooled, resulting in an improved interruption performance.

In the present embodiment, the same poles of the permanent magnets 9 and 10 are arranged to face each other, thereby increasing the radial component of the magnetic flux density B near a portion where the arc occurs. Furthermore, the permanent magnets 9 and 10 are closely arranged and accordingly the magnetic fluxes generated from the N-poles of the permanent magnets 9 and 10 act repulsively with each other to be directed in the radial direction, so that the radial component is greatly increased.

Figure 3:
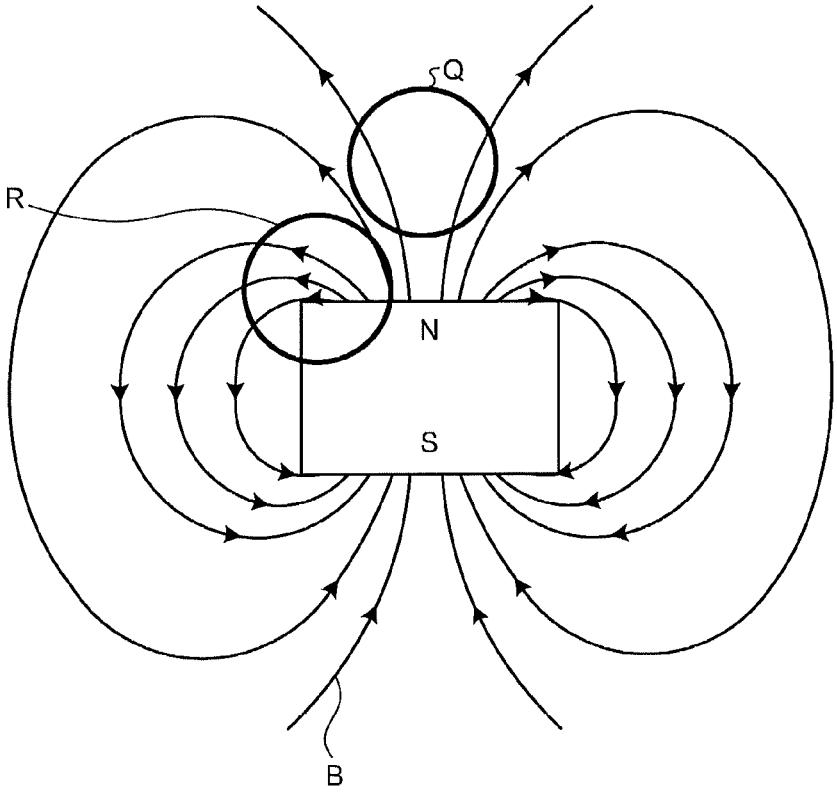
FIG. 3 depicts magnetic fluxes generated when there is a single permanent magnet.

This state is explained more specifically with reference to FIG. 3. FIG. 3 depicts magnetic fluxes generated when there is a single permanent magnet. As shown in FIG. 3, magnetic fluxes R near a corner of an end surface on an N-pole side of the permanent magnet tend to pass toward a direction perpendicular to the magnetizing direction (that is, the radial direction in FIG. 2). Meanwhile, magnetic fluxes Q near a central portion of the end surface on the N-pole side of the permanent magnet tend to pass toward the magnetizing direction (that is, the central axis direction in FIG. 2). The N-pole side of the permanent magnet 10 is therefore brought close to the N-pole side of the permanent magnet 9 as shown in FIG. 2, so that also magnetic fluxes corresponding to the magnetic fluxes Q in FIG. 3 can be directed in the radial direction by utilizing repulsion of the facing same poles to increase the magnetic flux density in the radial direction.

This fact indicates that the radial component of the magnetic flux density is greatly increased near corners of the facing permanent magnets 9 and 10 or a gap 50 formed between the permanent magnets 9 and 10. Therefore, it is desirable that the corners of the facing permanent magnets 9 and 10 or the gap 50 is located near the arc 60.

As shown in FIG. 1, the gap 50 is located on the side of the movable-side electrode unit 2 in the central axis direction (switching direction) relative to a contact/separation point P on the fixed-side arcing contact 8 for the movable contact 5. Because the arc 60 occurs like being pulled from the contact/separation point P toward the movable-side electrode unit 2, the interruption performance for the arc 60 is enhanced by positioning the gap 50 just beside an area where the arc 60 occurs as shown in FIG. 1. It is more preferable that the position of the gap 50 in the central axis direction is nearer the contact/separation point P because the arc 60 can be extinguished earlier. Because the permanent magnets 9 and 10 are arranged within the fixed-side shield 12, the position of the gap 50 is also within the fixed-side shield 12. Because a contact/separation point on the fixed-side main contact 7 for the movable contact 5 is provided on the side of the fixed-side electrode unit 3 relative to the contact/separation point P, the gap 50 is located on the side of the movable-side electrode unit 2 in the central axis direction relative to the contact/separation point on the fixed-side main contact 7 for the movable contact 5.

While it is more preferable that a distance of the gap 50 between the permanent magnets 9 and 10 is shorter in view of increasing the radial magnetic flux density, the assemblability is deteriorated because the repulsion of the magnets becomes too large when the distance is too short. Accordingly, the distance of the gap 50 is preferably several millimeters or longer, for example.

Figure 4:
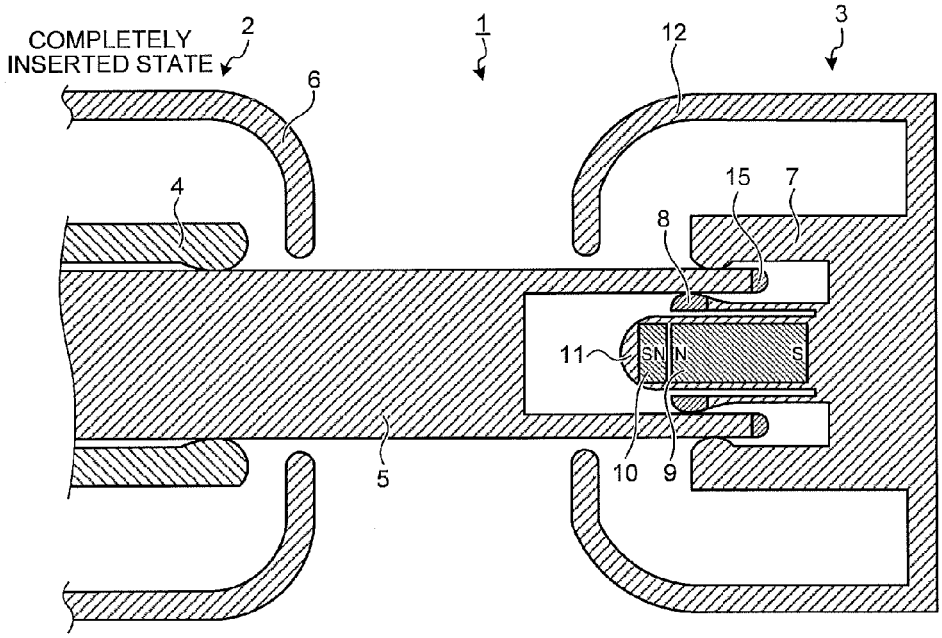
FIG. 4 depicts a cross-sectional configuration of an electric current switching unit in a completely inserted state.
Figure 5:
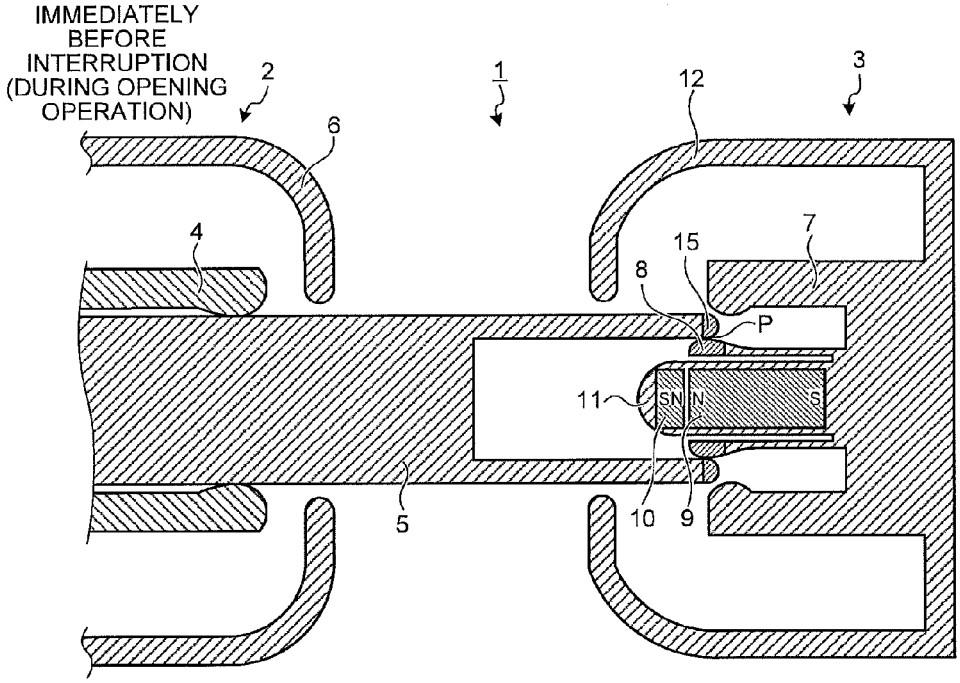
FIG. 5 depicts a cross-sectional configuration of the electric current switching unit immediately before interruption (during an opening operation).
Figure 6:
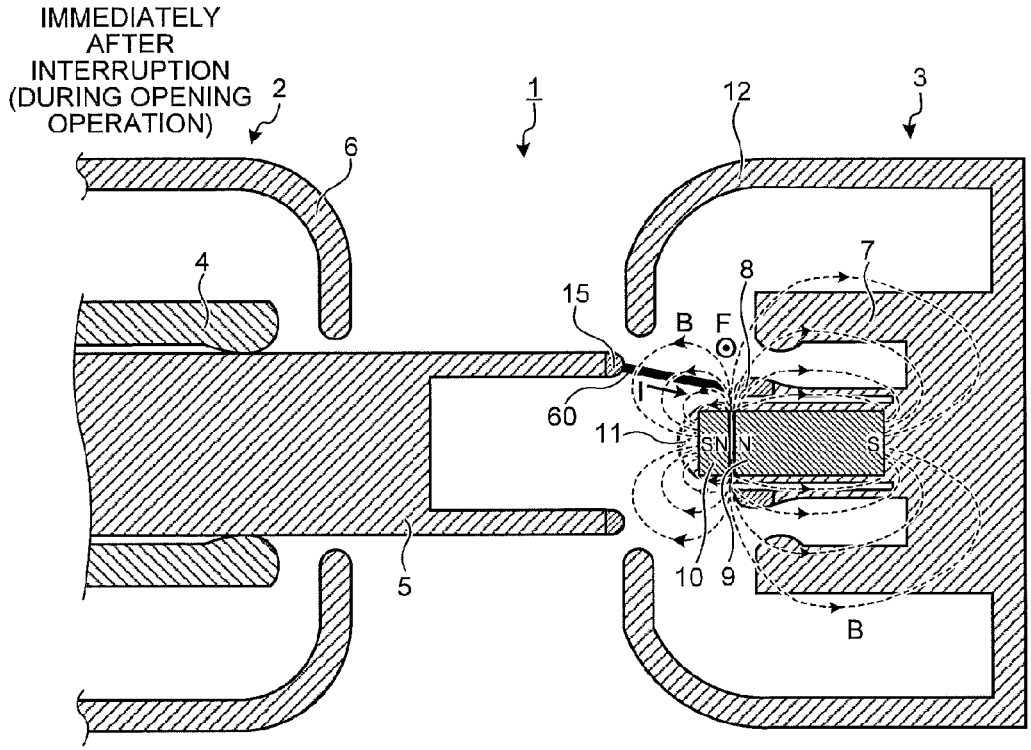
FIG. 6 depicts a cross-sectional configuration of the electric current switching unit immediately after the interruption (during an opening operation).
Figure 7:
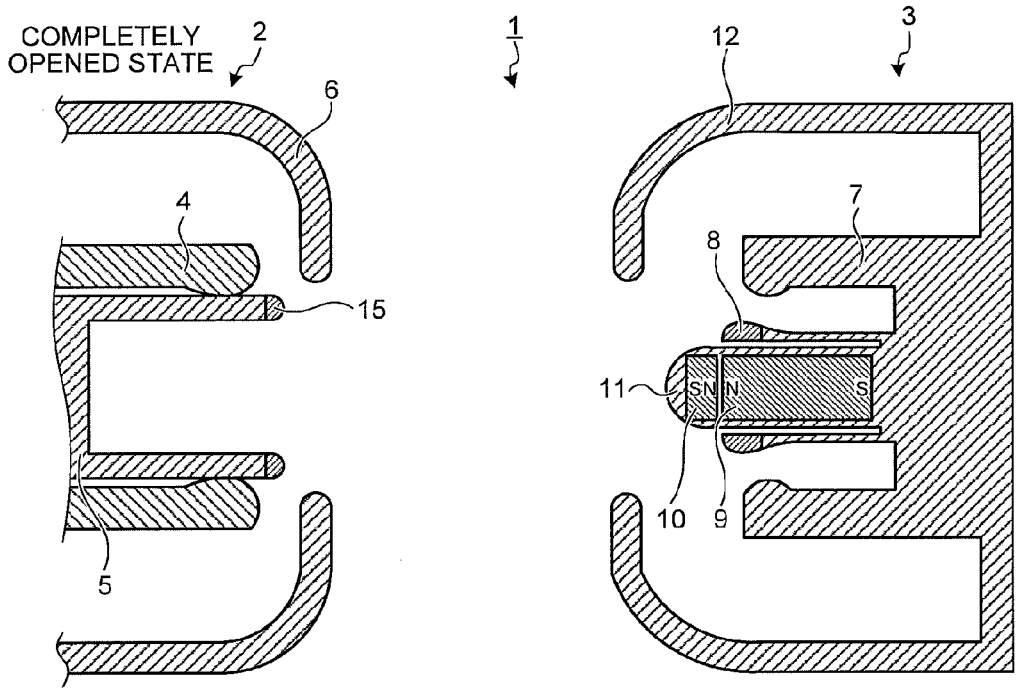
FIG. 7 depicts a cross-sectional configuration of the electric current switching unit in a completely opened state.

A contact opening operation according to the present embodiment is explained with reference to FIGS. 4 to 7. FIG. 4 depicts a cross-sectional configuration of the electric current switching unit in a completely inserted state, FIG. 5 depicts a cross-sectional configuration of the electric current switching unit immediately before interruption (during an opening operation), FIG. 6 depicts a cross-sectional configuration of the electric current switching unit immediately after the interruption (during the opening operation), and FIG. 7 depicts a cross-sectional configuration of the electric current switching unit in a completely opened state. Magnetic fluxes are shown only in FIG. 6.

First, when the electric current switching apparatus 1 is in a completely inserted state (closed) as shown in FIG. 4, electric current flows through the fixed-side main contact 7, the movable contact 5, and the movable-side main contact 4.

Next, when a contact opening command is issued to the electric current switching apparatus 1, the movable contact 5 is driven by the driving mechanism (not shown) toward the left in FIG. 5. This opens between the fixed-side main contact 7 and the movable contact 5 and accordingly the movable contact 5 is brought into a state to be contact with the fixed-side arcing contact 8 through the movable-side arcing contact 15 on the end of the movable contact 5 (FIG. 5).

When the contact opening further progresses, the movable-side arcing contact 15 and the fixed-side arcing contact 8 are opened and the arc 60 occurs therebetween. The arc 60 is rotationally driven around the central axis under the Lorentz force resulting from magnetic fields generated by the permanent magnets 9 and 10. At that time, because the same poles of the permanent magnets 9 and 10 are arranged to face each other, the magnetic fluxes near the surfaces of the N-poles are directed in the radial direction, thereby greatly enhancing the radial magnetic flux density near the corners of the facing permanent magnets 9 and 10 or the gap 50 therebetween. This greatly increases a driving force for the arc 60 and thus a performance to cool and extinguish the arc 60, that is, the interruption performance is greatly enhanced. After the arc 60 is extinguished, the contact opening further progresses, resulting in a completely opened state as shown in FIG. 7.

According to the present embodiment, the permanent magnets 9 and 10 are provided, for example, in the fixed-side electrode unit 3 in the electric current switching apparatus 1, and the permanent magnets 9 and 10 are arranged on the central axis of the fixed-side electrode unit 3 and to cause the same poles thereof face each other as if butting with each other. Therefore, the radial magnetic flux density near a place where the arc 60 occurs is greatly increased and the rotational driving force for the arc 60 caused by the radial magnetic flux density is greatly increased. This considerably enhances the interruption performance of the electric current switching apparatus 1.

In the present embodiment, the permanent magnets 9 and 10 are arranged in the fixed-side electrode unit 3, for example. Therefore, the permanent magnets 9 and 10 are located in an area nearer the arc occurrence portion than in a case where the permanent magnets are located in the movable-side electrode unit 2, which further increases the radial magnetic flux density near the arc occurrence portion. Accordingly, even when small magnets are used, a sufficient magnetic flux density in the radial direction can be obtained.

In the present embodiment, the permanent magnets 9 and 10 have bodies that are arranged on the central axis of the fixed-side electrode unit 3. This means that the permanent magnets 9 and 10 are located near the contact/separation point P, which is a base of the arc occurrence portion, and accordingly the radial magnetic flux density near the arc occurrence portion is further increased. Therefore, even when small magnets are used, a sufficient magnetic flux density in the radial direction can be obtained.

Furthermore, the permanent magnets 9 and 10 are arranged on the central axis and within the fixed-side arcing contact 8. This directs all the magnet fluxes near the gap 50 among those generated from the permanent magnets 9 and 10 toward outside in the radial direction, so that a sufficient magnetic flux density in the radial direction can be obtained even when small magnets are used. In a fourth embodiment of the present invention, there is described an example in which magnetic fluxes near a gap between facing permanent magnets are directed separately toward outside in the radial direction and toward inside in the radial direction.

Generally, by increasing the thickness in the magnetizing direction of a permanent magnet, a demagnetizing field of the permanent magnet itself can be reduced and a residual magnetic flux density can be increased, thereby increasing the magnetic flux density generated from the permanent magnet. In the present embodiment, the thickness of one of the two permanent magnets 9 and 10 is thus increased. That is, the thickness in the central axis direction (magnetizing direction) of the permanent magnet 9 is larger than that in the central axis direction (magnetizing direction) of the permanent magnet 10.

The permanent magnet 9 having the larger thickness is located on the side of the fixed-side electrode unit 3. Because a dimension in the central axis direction on the side of the movable-side electrode unit 2 is difficult to increase in view of design for insulation between the electrode units, the thickness of the permanent magnet 9 on the side of the fixed-side electrode unit 3 is increased. The increase in the thickness of the permanent magnet 9 on the side of the fixed-side electrode unit 3 is effective because it can further increase the radial magnetic flux density near the base of the arc occurrence portion. Similarly, when three or more permanent magnets are arranged, a thickness in the central axis direction of a permanent magnet located nearest to the fixed-side electrode unit 3 can be set largest. When a plurality of permanent magnets are arranged on the central axis, it is advantageously easier to set at least one of the permanent magnets at a larger thickness than in a case where the permanent magnets are arranged in other places.

Figure 11:
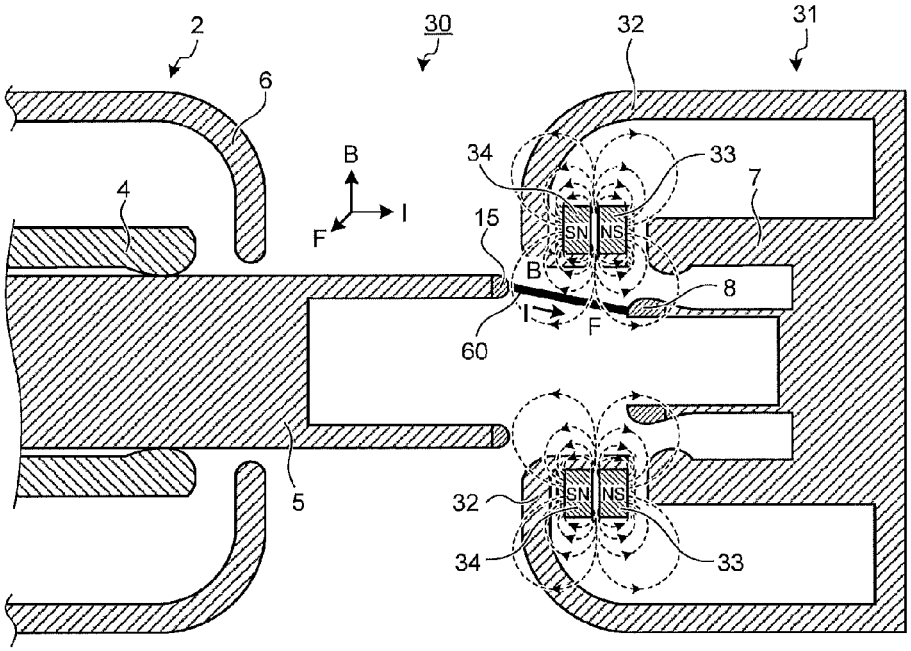
FIG. 11 is an explanatory diagram of an effect of permanent magnets provided in a fixed-side electrode unit in the fourth embodiment.
Figure 12:
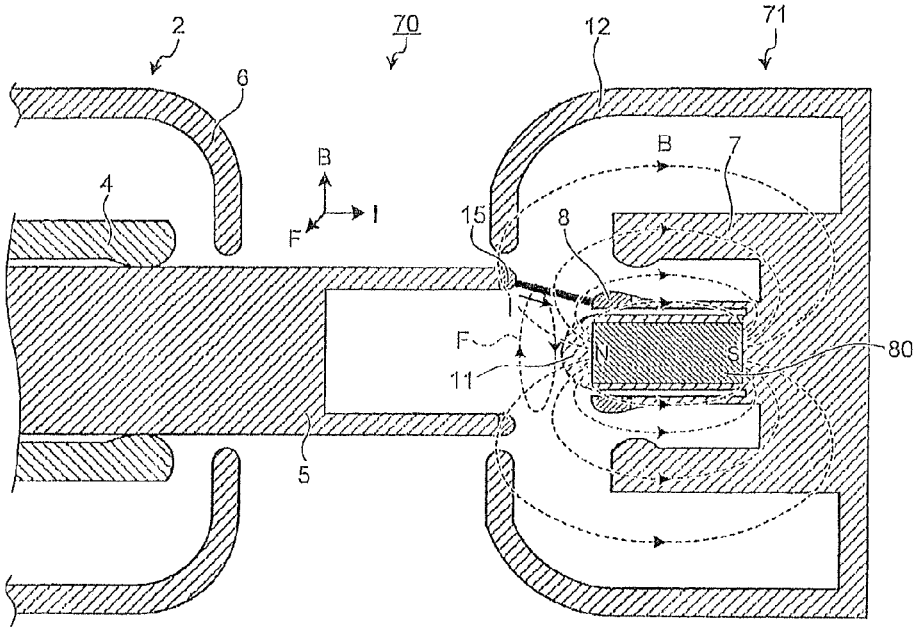
FIG.12 BACKGROUND ART
FIG. 12 depicts a cross-sectional configuration of an example of a conventional electric current switching apparatus.

An example of a conventional electric current switching apparatus is explained (see FIG. 11 in Patent Literature 1). FIG. 12 depicts a cross-sectional configuration of an example of a conventional electric current switching apparatus 70. As shown in FIG. 12, the electric current switching apparatus 70 includes the movable-side electrode unit 2 and a fixed-side electrode unit 71 that are arranged to face each other. The configuration of the movable-side electrode unit 2 is identical to that shown in FIG. 1. In the fixed-side electrode unit 71, a single permanent magnet 80 is arranged within the fixed-side arcing contact 8. Other configurations in FIG. 12 are identical to those in FIG. 1.

In the conventional electric current switching apparatus 70, a radial magnetic flux density is insufficiently low and prompt extinction of an arc is difficult in some cases such as when current specifications are high. That is, a radial component of a magnetic flux density generated from the single permanent magnet 80 is quite smaller than that in the present embodiment and thus the occurred arc is pulled long toward the movable-side electrode unit 2 without being promptly cut. This further increases a distance between the arc and the permanent magnet 80 and accordingly weakens a magnetic field effect, so that it becomes more difficult to rotate and extinguish the arc. When the arc is not extinguished yet in a state where the movable contact 5 is driven outside of the fixed-side shield 12, the arc may translocate to the fixed-side shield 12. When the arc translocates to the fixed-side shield 12, the surface of the fixed-side shield 12 is adversely worn. When the surface of the fixed-side shield 12 is covered with an arc-resistant material, an area to be covered is large, which adversely increases costs.

Figure 10:
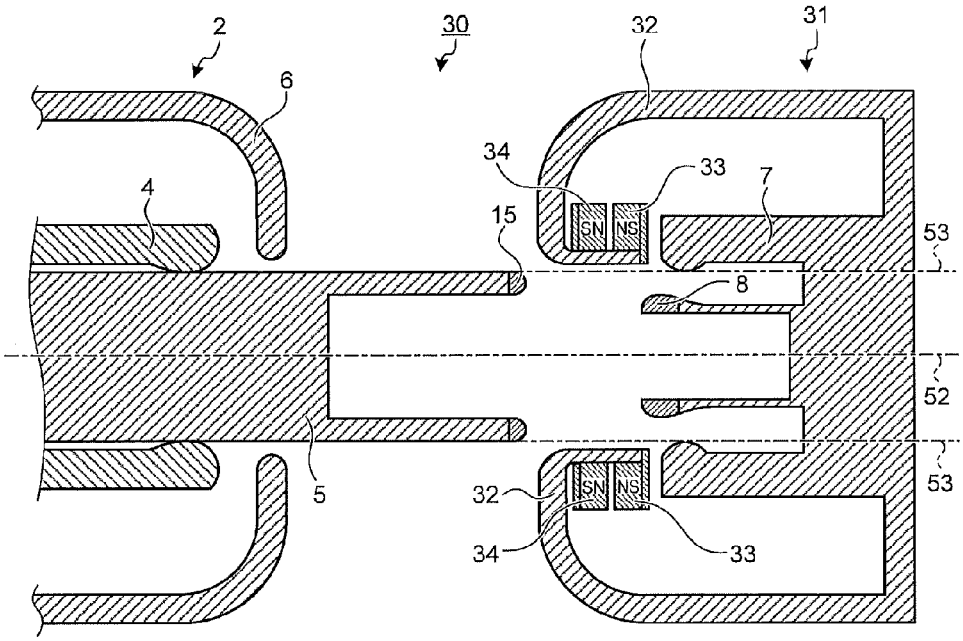
FIG. 10 depicts a cross-sectional configuration of an electric current switching apparatus according to a fourth embodiment.

FIG. 10 in Patent Literature 1 depicts a configuration in which a first permanent magnet is arranged within a movable contact and a second permanent magnet is arranged within a fixed-side arcing contact. A compression spring is attached to the first permanent magnet and the first permanent magnet is pushed by the fixed-side arcing contact in a closed state to bring the compression spring into a compressed state. However, the conventional technique has a problem that a complicated configuration is used due to such as the need to attach the compression spring to one of the permanent magnets. Furthermore, the conventional technique also has a problem that loads at the time of insertion of the movable contact are increased due to a repulsive force between the permanent magnets. On the other hand, in the present embodiment, a simple configuration without the need of a compression spring or the like can be used and also loads on the movable contact 5 are not increased at the time of insertion of the movable contact 5.

While the permanent magnets 9 and 10 are provided in the fixed-side electrode unit 3 in the present embodiment, these magnets can be alternatively provided in the movable-side electrode unit 2. In this case, the permanent magnets 9 and 10 can be arranged on the central axis in a space formed within the movable contact 5, for example.

A portion of the case 11 covering the permanent magnets 9 and 10, which is on the side of the movable-side electrode unit 2 (a portion covering the end surface of the permanent magnet 10 on the side of the movable-side electrode unit 2 and the like), can be made of an arc-resistant material. This prevents wearing of the portion even when the arc translocates to the portion. While the arc-resistant material is generally expensive, a portion that covers the permanent magnets 9 and 10 is small and accordingly an influence of increase in the costs is small even when the arc-resistant material is used for this portion.

The electric current switching apparatus 1 according to the present embodiment can be applied not only to the gas insulated switchgear using $SF_6$ or the like but can be similarly applied also to cases that use vacuum insulation, air insulation, fluid insulation, or the like. Other effects of the present embodiment are as described above with the explanations of the configurations and operations of the present embodiment.

Second Embodiment

Figure 8:
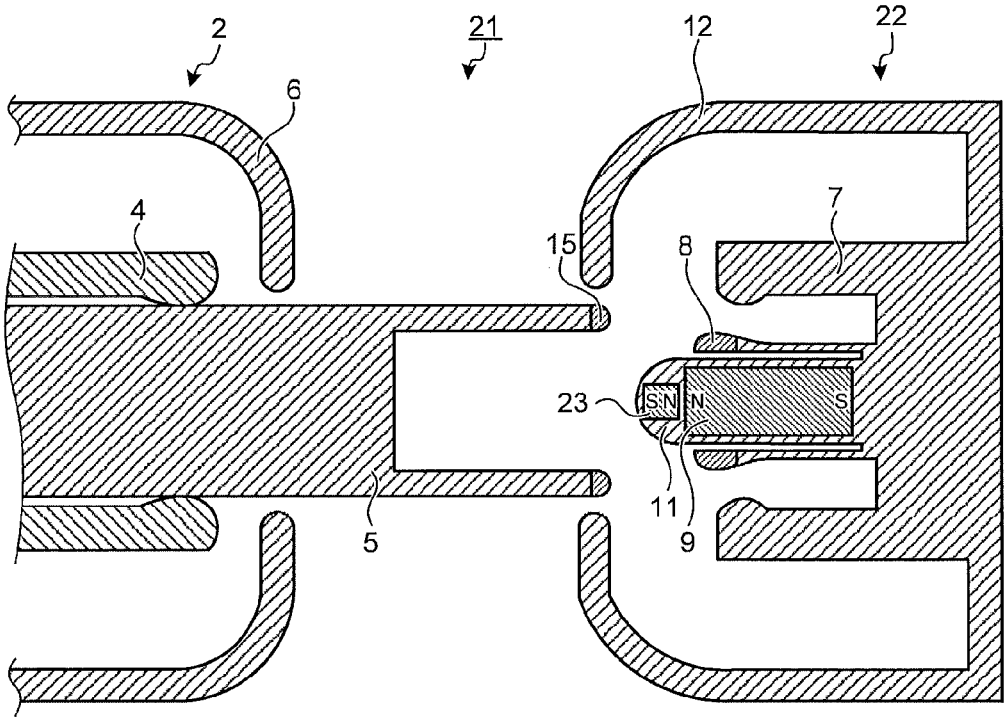
FIG. 8 depicts a cross-sectional configuration of an electric current switching apparatus according to a second embodiment.

FIG. 8 depicts a cross-sectional configuration of an electric current switching apparatus 21 according to a second embodiment of the present invention. The electric current switching apparatus 21 is a circuit breaker placed in a gas insulated switchgear, a disconnector with electric current switching specifications, or a grounding switch with electric current switching specifications, for example. FIG. 8 depicts a cross-sectional configuration of an electric current switching unit thereof.

The electric current switching apparatus 21 is arranged in a metallic container (not shown) having insulating gas such as $SF_6$ filled therein. The electric current switching apparatus 21 includes the movable-side electrode unit 2 and a fixed-side electrode unit 22 that are arranged to align central axes thereof with each other and to face each other. The definition of the central axes is identical to that in the first embodiment. The configuration of the movable-side electrode unit 2 is identical to that shown in FIG. 1. In the fixed-side electrode unit 22, the permanent magnet 9 and a permanent magnet 23 are arranged within the fixed-side arcing contact 8. Other configurations in FIG. 8 are identical to those in FIG. 1.

The permanent magnets 9 and 23 have bodies that are arranged on the central axis of the fixed-side electrode unit 22. These permanent magnets are arranged to align magnetizing directions thereof with the central axis direction and are closely arranged in such a manner that same poles thereof face each other. Specifically, the end surface of the permanent magnet 9 on the N-pole side and an end surface of the permanent magnet 23 on an N-pole side are arranged as if butting with each other, for example.

The permanent magnet 23 is located on the side of the movable-side electrode unit 2 and the permanent magnet 9 is located on the side of the fixed-side electrode unit 22. The permanent magnet 23 has a cross-section perpendicular to the central axis, which is smaller than that of the permanent magnet 9, and has a thickness in the central axis, which is smaller than that in the central axis of the permanent magnet 9. The permanent magnets 9 and 23 are covered with the case 11 and fixed to the fixed-side electrode unit 22.

The permanent magnets 9 and 23 can have pillar shapes such as circular pillar shapes or rectangular pillar shapes. For example, when the permanent magnets 9 and 23 have circular pillar shapes, the permanent magnet 23 has a diameter smaller than that of the permanent magnet 9.

A gap formed between the permanent magnets 9 and 23 is located on the side of the movable-side electrode unit 2 in the central axis direction (switching direction) relative to the contact/separation point on the fixed-side arcing contact 8 for the movable contact 5 as in the first embodiment.

Because an apex of the case 11 that covers the permanent magnets 9 and 23 has a round shape with a smooth curvature, it may be difficult to provide an enough space to place a permanent magnet in the apex. Accordingly, in the present embodiment, the permanent magnet 23 has smaller sizes both in the cross section and in the thickness than these of the permanent magnet 9 to adapt the permanent magnet 23 to the shape of the apex of the case 11, thereby facilitating the arrangement.

When the permanent magnets 9 and 23 are provided in the movable-side electrode unit 2, it is possible to arrange the permanent magnet 23 on the side of the fixed-side electrode unit 22 and the permanent magnet 9 on the side of the movable-side electrode unit 2. Generally, an outer diameter of a permanent magnet located nearer to an interelectrode gap between the movable-side electrode unit 2 and the fixed-side electrode unit 22 can be set smaller.

Furthermore, in the present embodiment, the thickness of the permanent magnet 9 can be set larger than that that in the first embodiment by reduction in the size of the permanent magnet 23 to be adapted to the shape of the apex of the case 11.

According to the present embodiment, a radial magnetic flux density can be greatly increased as compared to the conventional technology by arranging the same poles of the permanent magnets 9 and 23 face-to-face. Operations of the present embodiment are identical to those of the first embodiment. In addition, other effects of the present embodiment are as described in the first embodiment.

Third Embodiment

Figure 9:
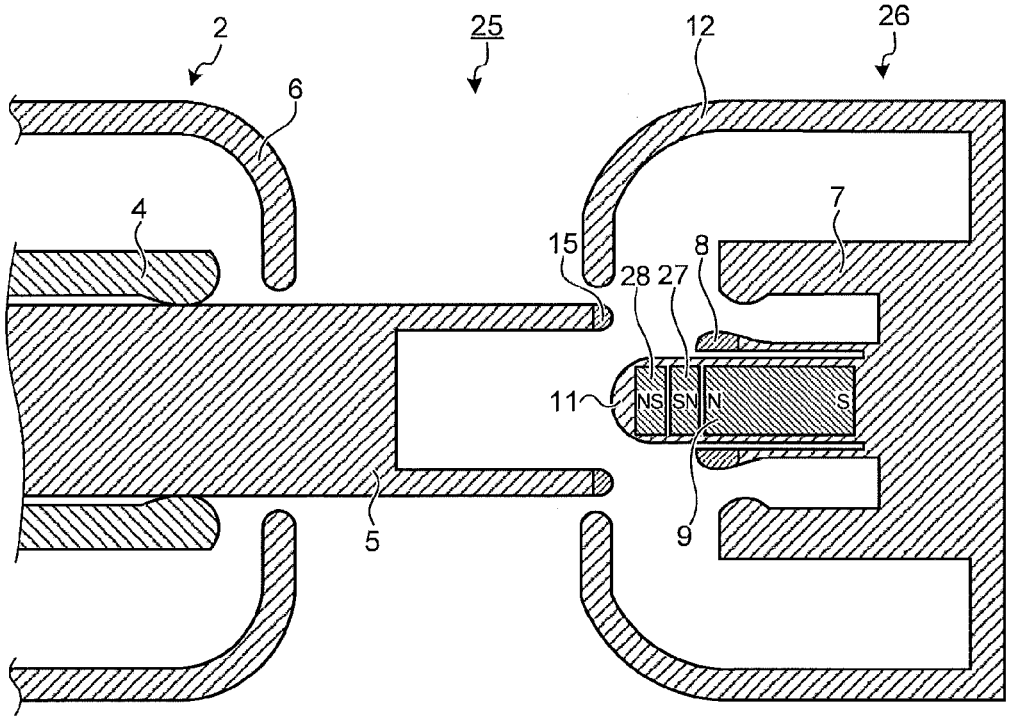
FIG. 9 depicts a cross-sectional configuration of an electric current switching apparatus according to a third embodiment.

FIG. 9 depicts a cross-sectional configuration of an electric current switching apparatus 25 according to a third embodiment of the present invention. The electric current switching apparatus 25 is a circuit breaker placed in a gas insulated switchgear, a disconnector with electric current switching specifications, or a grounding switch with electric current switching specifications, for example. FIG. 9 depicts a cross-sectional configuration of an electric current switching unit thereof.

The electric current switching apparatus 25 is arranged in a metallic container (not shown) having insulating gas such as $SF_6$ filled therein. The electric current switching apparatus 25 includes the movable-side electrode unit 2 and a fixed-side electrode unit 26 that are arranged to align central axes thereof with each other and to face each other. The definition of the central axes is identical to that in the first embodiment. The configuration of the movable-side electrode unit 2 is identical to that shown in FIG. 1. In the fixed-side electrode unit 26, the permanent magnet 9 and permanent magnets 27 and 28 are arranged within the fixed-side arcing contact 8. Other configurations in FIG. 9 are identical to those in FIG. 1.

The permanent magnets 9, 27, and 28 have bodies arranged on the central axis of the fixed-side electrode unit 26. These permanent magnets are arranged to align magnetizing directions thereof with the central axis direction and closely arranged in such a manner that same poles thereof face each other. Specifically, the end surface of the permanent magnet 9 on the N-pole side and an end surface of the permanent magnet 27 on an N-pole side are arranged face-to-face, and an end surface of the permanent magnet 27 on an S-pole side and an end surface of the permanent magnet 28 on an S-pole side are arranged face-to-face, for example.

The permanent magnets 9, 27, and 28 are arranged in this order from the side of the fixed-side electrode unit 26 to the side of the movable-side electrode unit 2. As for thicknesses in the central axis direction, the permanent magnet 9 located nearest the fixed-side electrode unit 26 has largest one and the permanent magnets 27 and 28 have almost equal one, for example.

The permanent magnets 9, 27, and 28 can have pillar shapes such as circular pillar shapes or rectangular pillar shapes. In FIG. 9, the permanent magnets 9, 27, and 28 have circular pillar shapes and have the same diameter.

A gap formed between the permanent magnets 9 and 27 and a gap formed between the permanent magnets 27 and 28 are both located on the side of the movable-side electrode unit 2 in the central axis direction (switching direction) relative to the contact/separation point on the fixed-side arcing contact 8 for the movable contact 5, as in the first embodiment.

Because an arc occurs from the contact/separation point toward the movable-side electrode unit 2, the two gaps are arranged just beside the area where the arc occurs. As explained in the first embodiment, a radial magnetic flux density is particularly high near these gaps.

According to the present embodiment, the arrangement of the three permanent magnets 9, 27, and 28, for example, in the fixed-side electrode unit 26 provides a plurality of (two in the example shown in the drawings) places in the central axis direction where the same poles face each other and the radial magnetic flux density is particularly high, which further improves the interruption performance. Conventionally, in some cases, an arc cannot be easily interrupted when the electric current specifications are high, for example, and thus the arc is extended to a certain length. However, according to the present embodiment, plural places where the radial magnetic flux density is particularly high are provided in the central axis direction and therefore the arc can be extinguished more promptly even when the electric current specifications are high.

Fourth Embodiment

FIG. 10 depicts a cross-sectional configuration of an electric current switching apparatus 30 according to the fourth embodiment of the present invention. The electric current switching apparatus 30 is a circuit breaker placed in a gas insulated switchgear, a disconnector with electric current switching specifications, or a grounding switch with electric current switching specifications, for example. FIG. 10 depicts a cross-sectional configuration of an electric current switching unit thereof.

The electric current switching apparatus 30 is arranged in a metallic container (not shown) having insulating gas such as $SF_6$ filled therein. The electric current switching apparatus 30 includes the movable-side electrode unit 2 and a fixed-side electrode unit 31 that are arranged to align central axes thereof with each other and to face each other. The definition of the central axes is identical to that in the first embodiment. The configuration of the movable-side electrode unit 2 is identical to that shown in FIG. 1.

In the fixed-side electrode unit 31, a fixed-side shield 32 that forms an outer surface of the fixed-side electrode unit 31 is provided. For example, two permanent magnets 33 and 34 are provided within the fixed-side shield 32 (on an inner surface thereof).

The permanent magnets 33 and 34 are ring-shaped, for example, and are arranged to align magnetizing directions thereof with the central axis direction and closely arranged in such a manner that same poles thereof face each other. Specifically, these permanent magnets are arranged in such a manner that an end surface of the permanent magnet 33 on an N-pole side and an end surface of the permanent magnet 34 on an N-pole side face each other, for example.

The permanent magnets 33 and 34 have bodies arranged outside of a cylindrical area 53 having a radius defined by an outer diameter of the movable contact 5 around the central axis 52 of the fixed-side electrode unit 31 (or the movable-side electrode unit 2). The paired permanent magnets 33 and 34 are arranged at an end of the fixed-side shield 32 on the side of the movable-side electrode unit 2. Therefore, the movable contact 5 contacts or separates from the fixed-side electrode unit 31 in such a way as to pass through the permanent magnets 33 and 34.

In the first to third embodiments, the plural permanent magnets are arranged inside of the cylindrical area 53 having the radius defined by the outside diameter of the movable contact 5 around the central axis 52. Specifically, the permanent magnets are arranged inside of the fixed-side arcing contact 8 and particularly the bodies are arranged on the central axis 52.

A gap formed between the permanent magnets 33 and 34 is located on the side of the movable-side electrode unit 2 in the central axis direction (switching direction) relative to the contact/separation point on the fixed-side arcing contact 8 for the movable contact 5, as in the first embodiment.

FIG. 11 is an explanatory diagram of an effect of the permanent magnets 33 and 34 provided in the fixed-side electrode unit 31. FIG. 11 depicts a state immediately after interruption during an opening operation of the electric current switching apparatus 30, in which the arc 60 occurs between the fixed-side arcing contact 8 and the movable-side arcing contact 15. Magnetic fluxes generated from the permanent magnets 33 and 34 are denoted by dotted lines including arrows. In FIG. 10 and FIG. 11, constituent elements identical to those shown in FIG. 1 are denoted by like reference signs.

As shown in FIG. 11, the arc current I flows between the fixed-side arcing contact 8 and the movable-side arcing contact 15 with occurrence of the arc 60 and the current I is subject to the Lorentz force F in a direction perpendicular to the current I and a magnetic flux density B generated from the permanent magnets 33 and 34 due to the magnetic flux density B. Because the flowing direction of the arc current I is substantially the central axis direction as shown in FIG. 11, the current I is subject to the Lorentz force F resulting from a radial component among components of the magnetic flux density B, which rotationally drives the arc 60 around the central axis. Therefore, when the radial component of the magnetic flux density B is increased, rotational driving of the arc 60 is enhanced and the arc 60 is efficiently cooled, so that the interruption performance is improved.

In the present embodiment, the same poles of the permanent magnets 33 and 34 are arranged to face each other, thereby increasing the radial component of the magnetic flux density B near an arc occurrence portion. Furthermore, the permanent magnets 33 and 34 are arranged closely to each other and thus magnetic fluxes generated from the N-poles of the permanent magnets 33 and 34 act repulsively with each other to be directed in the radial direction, which greatly increases the radial component.

According to the present embodiment, the permanent magnets 33 and 34 as plural permanent magnets are arranged inside (on the inner surface) of the fixed-side shield 32 and outside of the cylindrical area 53 having the radius defined by the outer diameter of the movable contact 5 around the central axis 52. Therefore, the arrangement positions of the permanent magnets 33 and 34 become closer to the fixed-side shield 32 and accordingly an arc can be promptly rotationally driven and extinguished even when the arc translocates to the fixed-side shield 32.

In the present embodiment, the permanent magnets 33 and 34 have the ring shapes, for example. Because these are versatile shapes and also the gas insulated switchgear basically has a coaxial cylinder shape, these permanent magnets are suitable for installation in the electrode units. Particularly the ring shapes are suitable for installation in the fixed-side shield 32 through which the movable contact 5 passes.

Instead of using the ring-shaped permanent magnets, the permanent magnets 33 and 34 can be formed by arranging a plurality of divided permanent magnets in an annular form, for example. In this case, individual permanent magnets have circular pillar shapes, for example, and plural pairs of permanent magnets having same poles arranged face-to-face are placed on the circumference of a circle around the central axis 52.

In the present embodiment, the permanent magnets 33 and 34 are ring-shaped having same inside and outside diameters. This facilitates installation of the permanent magnets 33 and 34 in the electrode unit.

An apex of the fixed-side shield 32 is curved toward the fixed-side main contact 7 for installation of the permanent magnets 33 and 34. That is, the fixed-side shield 32 has the apex formed in a substantially L-shaped cross-section on the side of the movable-side electrode unit 2. The inside diameter of the permanent magnet 34 on an interelectrode gap side can be set larger than that of the permanent magnet 33, or the outside diameter of the permanent magnet 34 can be set smaller than that of the permanent magnet 33. This facilitates the installation of the permanent magnets 33 and 34 in the fixed-side shield 32. Installation modes of the permanent magnets 33 and 34 are not limited to that shown in the drawings and other modes can be applied as long as the permanent magnets 33 and 34 are installed on the inner surface of the fixed-side shield 32.

Figure 13:
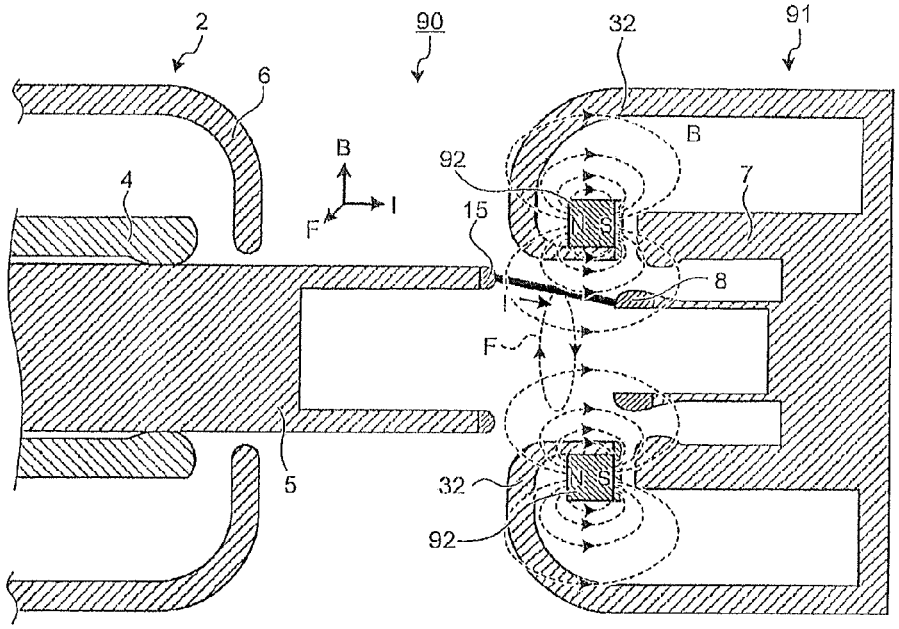
FIG.13 BACKGROUND ART
FIG. 13 depicts a cross-sectional configuration of another example of a conventional electric current switching apparatus.

Another example of the conventional electric current switching apparatus is explained. FIG. 13 depicts a cross-sectional configuration of another example of a conventional electric current switching apparatus 90. As shown in FIG. 13, the electric current switching apparatus 90 includes the movable-side electrode unit 2 and a fixed-side electrode unit 91 that are arranged to face each other. The configuration of the movable-side electrode unit 2 is identical to that shown in FIG. 1. A single ring-shaped permanent magnet 92 is provided inside (on an inner surface) of the fixed-side shield 32. Other configurations in FIG. 13 are identical to those in FIG. 12.

In the conventional electric current switching apparatus 90, a radial magnetic flux density is insufficiently low and thus prompt extinction of an arc is difficult in some cases such as when electric current specifications are high. That is, because a radial component of the magnetic flux density generated from the single permanent magnet 92 is quite smaller than that in the present embodiment, an occurred arc cannot be promptly cut and the interruption performance is adversely low.

The permanent magnets 33 and 34 can be alternatively arranged inside of the movable-side shield 6 that constitutes an outer surface of the movable-side electrode unit 2. While the permanent magnets 33 and 34 can be provided in the movable-side electrode unit 2, the permanent magnets 33 and 34 are provided inside of the shield in either case of being provided on the movable side or on the fixed side.

Modes obtained by combining the present embodiment and each of the first to third embodiments can be also carried out.

While the permanent magnets are provided in the fixed-side electrode unit in the first to fourth embodiments, configurations in which the permanent magnets are provided in at least one of the fixed-side electrode unit and the movable-side electrode unit are possible. That is, a configuration in which plural permanent magnets are provided in the fixed-side electrode unit to cause same poles of adjacent permanent magnets to face each other, a configuration in which plural permanent magnets are provided in the movable-side electrode unit to cause same poles of adjacent permanent magnets to face each other, or a configuration in which plural first permanent magnets are arranged in the fixed-side electrode unit to cause same poles of adjacent permanent magnets to face each other and plural second permanent magnets are arranged in the movable-side electrode unit to cause same poles of adjacent permanent magnets to face each other is possible. Various combinations such as a combination of the permanent magnets 33 and 34 in the present embodiment and the permanent magnets 9 and 10 in the first embodiment are possible.

Fifth Embodiment

Figure 14:
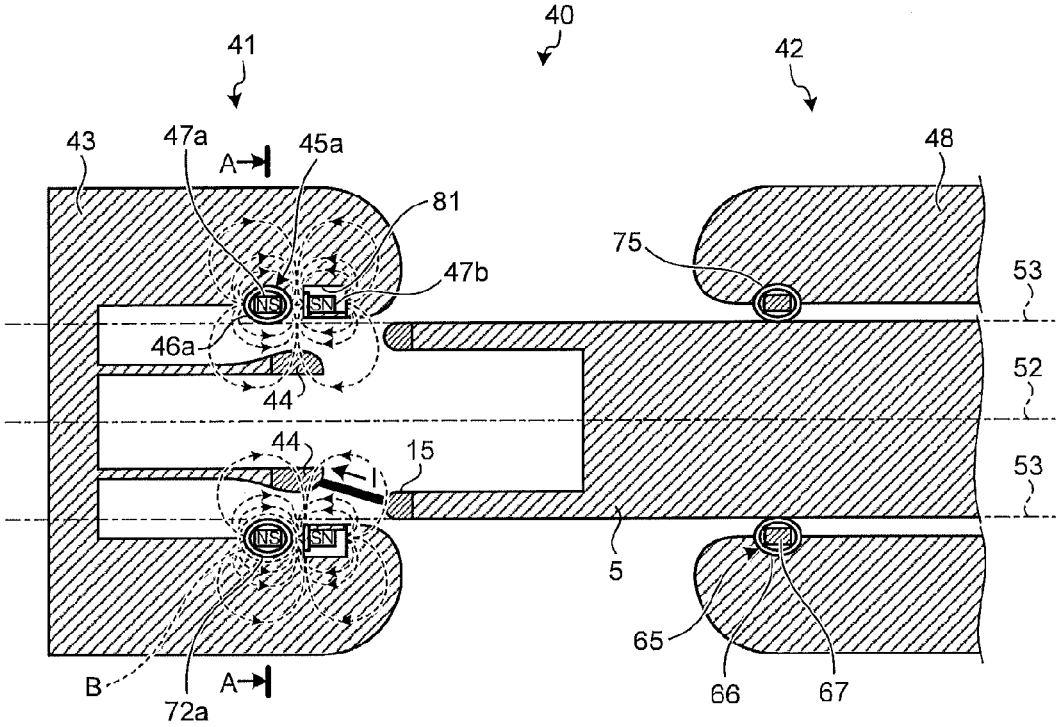
FIG. 14 depicts a cross-sectional configuration of an electric current switching apparatus according to a fifth embodiment.

FIG. 14 depicts a cross-sectional configuration of an electric current switching apparatus 40 according to a fifth embodiment of the present invention. The electric current switching apparatus 40 is a circuit breaker placed in a gas insulated switchgear, a disconnector with electric current switching specifications, or a grounding switch with electric current switching specifications, for example. FIG. 14 depicts a cross-sectional configuration of an electric current switching unit thereof.

The electric current switching apparatus 40 is arranged in a metallic container (not shown) having insulating gas such as $SF_6$ filled therein. The electric current switching apparatus 40 includes a fixed-side electrode unit 41 and a movable-side electrode unit 42 that have central axes aligned with each other (that is, the central axis 52) and are arranged to face each other.

The movable-side electrode unit 42 includes the movable contact 5 that is formed in a tubular shape and can reciprocate in a direction of the central axis 52, the movable-side arcing contact 15 that is provided in a tubular shape at an end of the movable contact 5 and is made of an arc-resistant material, a movable-side shield 48 for electric field relaxation that is provided around the movable contact 5, and an annular coil spring contact 65 that is provided in an annular groove 75 formed along an inner circumference of the movable-side shield 48 and contacts the movable-side shield 48 and the movable contact 5 to bring the movable-side shield 48 and the movable contact 5 into conduction. The inner circumference of the movable-side shield 48 means an inner circumference around the central axis 52.

The coil spring contact 65 includes an inclined coil spring 66 that has a coil wound inclinedly to and spirally around a winding axis and has an elliptical cross-section, and a ring 67 inserted within the inclined coil spring 66. The inclined coil spring 66 is made of, for example, a copper alloy having a high spring property. The ring 67 is made of, for example, an insulating material and has a rigidity to enable the inclined coil spring 66 to be kept in an annular shape.

The fixed-side electrode unit 41 includes a fixed-side arcing contact 44 provided in a tubular shape around the central axis 52 and made of an arc-resistant material, a fixed-side shield 43 for electric field relaxation provided around the fixed-side arcing contact 44, an annular coil spring contact 45*a* installed in an annular groove 72*a* that is formed on an inner circumference of the fixed-side shield 43, and a ring-shaped permanent magnet 47*b* arranged on the side of the movable-side electrode unit 42 relative to the coil spring contact 45*a* and installed in an annular groove 81 having, for example, a rectangular cross-section and being formed on the inner circumference of the fixed-side shield 43. The inner circumference of the fixed-side shield 43 means an inner circumference around the central axis 52. The fixed-side shield 43 includes a conductor having a fitting hole into which the movable contact 5 can be inserted, and the fixed-side arcing contact 44 is arranged within the fitting hole.

The coil spring contact 45*a* includes an inclined coil spring 46*a* that has a coil wound inclinedly to and spirally around a winding axis and has an elliptical cross-section, and a ring-shaped permanent magnet 47*a* inserted within the inclined coil spring 46*a*. The inclined coil spring 46*a* is made of, for example, a copper alloy having a high spring property. The permanent magnet 47*b* is fixed, for example, on a side surface of the annular groove 81 and is also supported by a tubular metallic member from inside of the fixed-side shield 43. The installation method of the permanent magnet 47*b* is not limited to that of the example shown in the drawings.

Figure 15:
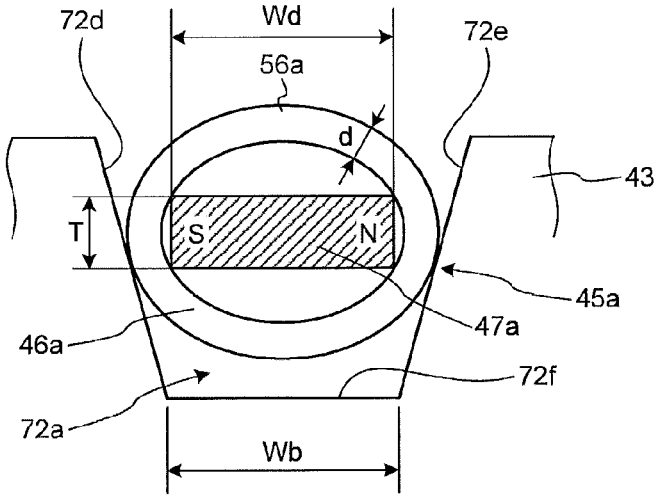
FIG. 15 is an enlarged view of a part B in FIG. 14.

Details of the coil spring contact 45*a* are explained with reference to FIGS. 15 to 17. FIG. 15 is an enlarged view of a part B in FIG. 14, FIG. 16 is a transverse cross-sectional view along a line A-A in FIG. 14, and FIG. 17 is a side view of the inclined coil spring according to the present embodiment.

Figure 16:
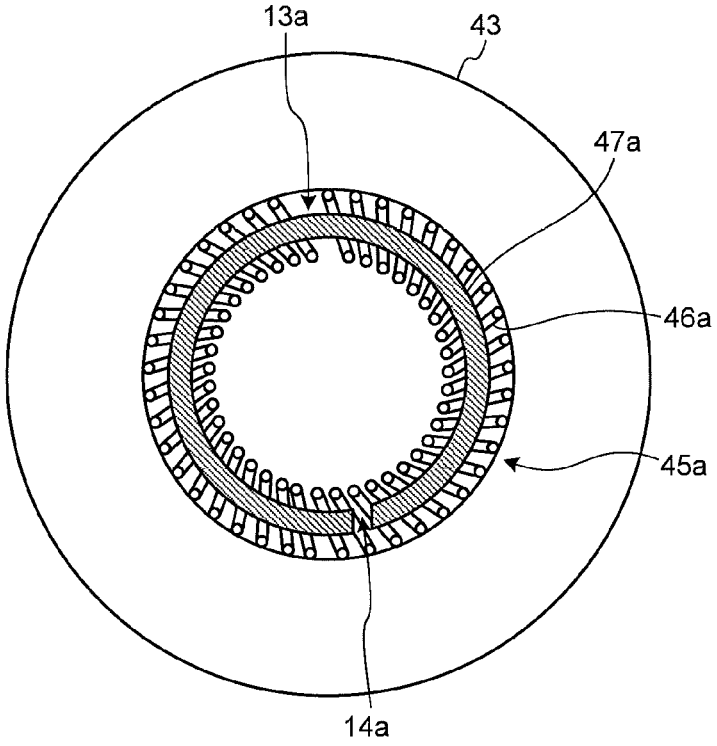
FIG. 16 is a transverse cross-sectional view along a line A-A in FIG. 14.
Figure 17:
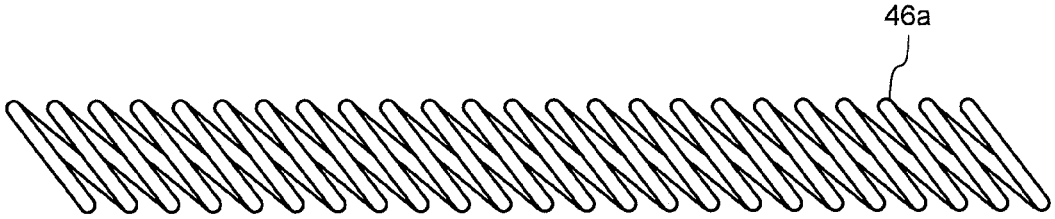
FIG. 17 is a side view of an inclined coil spring according to the fifth embodiment.

As shown in FIGS. 15 to 17, the permanent magnet 47*a* has a rectangular cross section, for example, and a width dimension Wd of the cross section in the direction of the central axis 52 is formed larger than a thickness dimension T in the radial direction. This formation ensures a gap in a radial direction between the inclined coil spring 46*a* and the permanent magnet 47*a* even when the inclined coil spring 46*a* is radially compressed by the movable contact 5 and then the coil is further inclined. The radial direction indicates a direction perpendicular to the central axis 52.

The inclined coil spring 46*a* is inclinedly and spirally wound in an elliptical shape and in such a manner that a minor axis of the ellipse forms an acute angle to a center line of the coil, and is installed in the annular groove 72*a* to direct a major axis of the ellipse in the direction of the central axis 52 and the minor axis thereof in the radial direction. The permanent magnet 47*a* has both ends in the direction of the central axis 52 contacting the inner circumference of the inclined coil spring 46*a*.

With this configuration, the both ends of the permanent magnet 47*a* in the direction of the central axis 52 stop deformation of the inclined coil spring 46*a* in the major axis direction and prevents distortion of the inclined coil spring 46*a* in the annular groove 72*a*, thereby allowing only deformation in the minor axis direction. Because the inclined coil spring 46*a* is arranged in the annular groove 72*a* to direct the minor axis in the radial direction, the annular groove 72*a* can be shallow and thus deep groove processing is not required, thereby avoiding increase in processing costs and reduction in a current-carrying cross-sectional area of the fixed-side shield 43.

As shown in FIG. 15, the annular groove 72*a* has widths that are narrower at positions nearer to the bottom, and the inclined coil spring 46*a* has a gap from a bottom surface 72*f* of the annular groove 72*a*, has a top 56*a* protruding from the annular groove 72*a*, and is engaged therein to contact side surfaces 72*d* and 72*e* of the annular groove 72*a*. That is, the inclined coil spring 46*a* is caused to contact the fixed-side shield 43 at two points to reduce contact electrical resistance.

Furthermore, as shown in FIG. 16, a cut portion 14*a* of the permanent magnet 47*a* is circumferentially shifted from a facing portion 13*a* of both ends of the inclined coil spring 46*a*. An angle of shift is preferably 180°, for example. By shifting the cut portion 14*a* and the facing portion 13*a* which are structurally weak portions from each other, an assembly structure of the inclined coil spring 46*a* and the permanent magnet 47*a* becomes strong and also a risk of dropout of the inclined coil spring 46*a* from the cut portion 14*a* of the permanent magnet 47*a* can be avoided.

The coil spring contact 65 has the same structure as mentioned above except that the ring 67 is not a permanent magnet (see Patent Literature 2 as for the details of the coil spring contact).

In the present embodiment, a fixed-side contact includes the coil spring contact 45*a* and the fixed-side arcing contact 44. The movable contact 5 moves forward and backward in a space between the coil spring contact 45*a* and the fixed-side arcing contact 44 and contacts or separates from the coil spring contact 45*a* and the fixed-side arcing contact 44, thereby switching current flowing between the fixed-side electrode unit 41 and the movable-side electrode unit 42. The movable contact 5 contacts the coil spring contact 45*a* in a manner to pass through the coil spring contact 45*a* and the permanent magnet 47*b*. Therefore, the bodies of the permanent magnets 47*a* and 47*b* are located outside of the cylindrical area 53 having the radius defined by the outside diameter of the movable contact 5 around the central axis 52. The permanent magnets 47*a* and 47*b* are located within the fixed-side shield 43.

In the present embodiment, the permanent magnets 47*a* and 47*b* are arranged to have respective magnetizing directions aligned with the direction of the central axis 52 and in such a manner that same poles thereof face each other. Specifically, an end surface of the permanent magnet 47*a* on an S-pole side and an end surface of the permanent magnet 47*b* on an S-pole side are arranged face-to-face. It is also possible to use a configuration in which an end surface of the permanent magnet 47*a* on an N-pole side and an end surface of the permanent magnet 47*b* on a N-pole side are arranged face-to-face. The permanent magnets 47*a* and 47*b* are ring-shaped having same inside and outside diameters, for example.

The effect of face-to-face arrangement of the same poles of the permanent magnets is identical to that in the fourth embodiment. That is, a radial component of a magnetic flux density near an arc occurrence portion is increased by the face-to-face arrangement of the same poles of the permanent magnets 47*a* and 47*b*. Furthermore, close arrangement of the permanent magnets 47*a* and 47*b* causes magnetic fluxes generated from the S-poles of the permanent magnets 47*a* and 47*b* to act repulsively with each other and to be directed in the radial direction, thereby greatly increasing the radial component. Therefore, an arc occurring between the fixed-side arcing contact 44 and the movable-side arcing contact 15 during an opening operation, for example, is effectively rotationally driven by the magnetic fluxes of the permanent magnets 47*a* and 47*b*, resulting in an improved interruption performance of the electric current switching apparatus 40. In FIG. 14, the magnetic fluxes generated from the permanent magnets 47*a* and 47*b* are denoted by dotted lines including arrows.

A gap formed between the permanent magnets 47*a* and 47*b* is located almost at the same position as a contact/separation point of the fixed-side arcing contact 44 for the movable contact 5 or located on the side of to the movable-side electrode unit 2 in the central axis direction (switching direction) relative to the contact/separation point, thereby improving the arc interruption performance. In the example shown in FIG. 14, the gap formed between the permanent magnets 47*a* and 47*b* is located almost at the same position as the contact/separation point on the fixed-side arcing contact 44 for the movable contact 5.

A plurality of the coil spring contacts can be arranged in the direction of the central axis 52 on the inner surface of the fixed-side shield 43. A permanent magnet having the same configuration as the permanent magnet 47*b* arranged within the fixed-side shield 43 can be arranged in the direction of the central axis 52, that is, a plurality of the permanent magnets 47*b* can be arranged. In this case, the permanent magnets 47*b* are preferably arranged on the side of the movable-side electrode unit 42, as in the FIG. 14, to effectively extinguish an occurred arc.

Generally, any configuration can be applied as long as ring-shaped permanent magnets are arranged within the fixed-side shield 43 in the direction of the central axis 52, same poles of adjacent permanent magnets are arranged to face each other, and at least one of the permanent magnets is inserted within the inclined coil spring to form an annular coil spring contact together with the inclined coil spring. For example, all of the permanent magnets can be arranged within the coil spring contact. As described above, it is desirable that at least one of gaps between adjacent ones of the permanent magnets is located on the side of the movable-side electrode unit 42 in the direction of the central axis 52 relative to the contact/separation point on the fixed-side arcing contact 44 for the movable contact 5, or located almost at the same position as the contact/separation point (see FIG. 14). A configuration example in which plural coil spring contacts are provided on the inner surface of the fixed-side shield 43 is explained with reference to FIG. 18.

Figure 18:
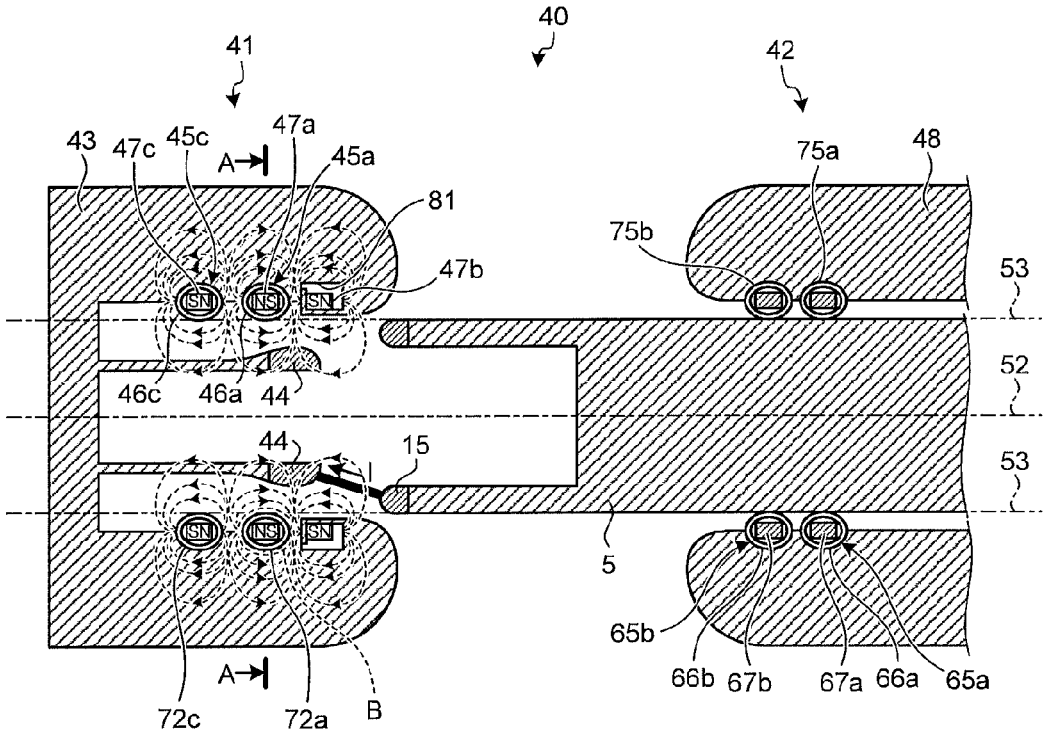
FIG. 18 is a modification of the fifth embodiment.

FIG. 18 is a modification of the present embodiment in which, for example, two coil spring contacts 45*a* and 45*c* are arranged in the direction of the central axis 52 on the inner surface of the fixed-side shield 43. The coil spring contact 45*c* has the same configuration as the coil spring contact 45*a*. The coil spring contact 45*c* includes an inclined coil spring 46*c* having a coil wound inclinedly to and spirally around a winding axis and having an elliptical cross-section, and a ring-shaped permanent magnet 47*c* inserted within the inclined coil spring 46*c*, and is installed in an annular groove 72*c* formed on the inner circumference of the fixed-side shield 43. An N-pole of the permanent magnet 47*c* of the coil spring contact 45*c* and the N-pole of the permanent magnet 47*a* of the coil spring contact 45*a* face each other. That is, same poles of adjacent permanent magnets are arranged to face each other as if butting with each other.

As shown in FIG. 18, the movable-side electrode unit 42 has annular coil spring contacts 65*a* and 65*b*. The coil spring contacts 65*a* and 65*b* are installed in annular grooves 75*a* and 75*b* formed along the inner circumference of the movable-side shield 48, respectively, and contact the movable-side shield 48 and the movable contact 5 to bring these into conduction. The coil spring contact 65*a* includes an inclined coil spring 66*a* and a ring 67*a* inserted within the inclined coil spring 66*a*. Similarly, the coil spring contact 65*b* includes an inclined coil spring 66*b* and a ring 67*b* inserted within the inclined coil spring 66*b*. The coil spring contacts 65*a* and 65*b* have the same configuration as the coil spring contact 65 shown in FIG. 14. In FIG. 18, the numbers of the respective coil spring contacts in the movable-side electrode unit 42 and the fixed-side electrode unit 41 are the same and two, which means that the number of the coil spring contacts is larger than that in the example shown in FIG. 14. Therefore, this modification is suitable in cases where an amount of current flowing between the movable-side electrode unit 42 and the fixed-side electrode unit 41 is large.

According to the present embodiment, the ring-shaped permanent magnet is arranged within the inclined coil spring that constitutes the coil spring contact. Accordingly, the permanent magnet enables the coil spring contact to be kept in an annular shape and also achieves space-saving.

In FIG. 10, for example, the tulip-shaped fixed-side main contact 7 and the permanent magnets 33 and 34 are arranged in the direction of the central axis 52, and the permanent magnets 33 and 34 are placed on the side of the movable-side electrode unit 2 relative to the fixed-side main contact 7. On the other hand, in the present embodiment, the permanent magnets 47*a* and 47*c* are arranged within the coil spring contacts 45*a* and 45*c*, respectively, as shown in FIG. 18, for example. Accordingly, the length of the fixed-side electrode unit 41 in the direction of the central axis 52 is reduced.

Furthermore, according to the present embodiment, the permanent magnets 47*a* and 47*b* are arranged inside of the fixed-side shield 43 and outside of the cylindrical area 53 having the radius defined by the outside diameter of the movable contact 5 around the central axis 52 as shown in FIG. 14, for example. Therefore, the arrangement positions of the permanent magnets 47*a* and 47*b* become closer to the fixed-side shield 43 and thus an arc can be promptly rotationally driven and extinguished even when the arc translocates to the fixed-side shield 43.

While the permanent magnets (the permanent magnets 47*a* and 47*b*, for example) are provided in the fixed-side electrode unit 41 in the present embodiment, the permanent magnets can be provided in at least one of the fixed-side electrode unit 41 and the movable-side electrode unit 42. For example, in FIG. 14, it is also possible to use a permanent magnet for the ring 67 of the coil spring contact 65 and provide a plurality of such coil spring contacts 65 in the movable-side electrode unit 42. In this case, it is preferable that same poles of the permanent magnets of adjacent coil spring contacts are arranged to face each other and that the number of the coil spring contacts provided in the fixed-side electrode unit 41 is equal to the number of the coil spring contacts provided in the movable-side electrode unit 42.

INDUSTRIAL APPLICABILITY

As described above, the present invention is useful as an electric current switching apparatus used in a gas insulated switchgear, for example.

REFERENCE SIGNS LIST

1, 21, 25, 30, 40, 70, 90 ELECTRIC CURRENT SWITCHING APPARATUS
2, 42 MOVABLE-SIDE ELECTRODE UNIT
3, 22, 26, 31, 41, 71, 91 FIXED-SIDE ELECTRODE UNIT
4 MOVABLE-SIDE MAIN CONTACT
5 MOVABLE CONTACT
6, 48 MOVABLE-SIDE SHIELD
7 FIXED-SIDE MAIN CONTACT
8, 44 FIXED-SIDE ARCING CONTACT
9, 10, 23, 27, 28, 33, 34, 47*a*, 47*b*, 47*c* PERMANENT MAGNET
80, 92 PERMANENT MAGNET
11 CASE
12, 32, 43 FIXED-SIDE SHIELD
15 MOVABLE-SIDE ARCING CONTACT
45*a*, 45*c*, 65, 65*a*, 65*b* COIL SPRING CONTACT
46*a*, 46*c*, 66, 66*a*, 66*b* INCLINED COIL SPRING
56*a* TOP
50 GAP
52 CENTRAL AXIS
53 AREA
60 ARC
67, 67*a*, 67*b* RING
72*a*, 72*c*, 75, 75*a*, 75*b*, 81 ANNULAR GROOVE
72*f* BOTTOM SURFACE
72*d* SIDE SURFACE

The invention claimed is:

1. An electric current switching apparatus having a fixed-side electrode unit and a movable-side electrode unit that are arranged to align central axes thereof with each other and to face each other, in which a movable contact provided in the movable-side electrode unit reciprocates on the central axis to contact or separate from a fixed-side contact provided in the fixed-side electrode unit, thereby switching electric current flowing between the fixed-side electrode unit and the movable-side electrode unit, the electric current switching apparatus comprising a plurality of permanent magnets that are permanently fixed relative to each other within the fixed-side electrode unit or the movable-side electrode unit, are arranged to have magnetizing directions thereof aligned with a direction of the central axis, are arranged within a cylindrical area having a radius defined by an outer diameter of the movable contact around the central axis, and are arranged to cause same poles of adjacent permanent magnets to face each other in a direction of the central axis as if butting with each other.

2. The electric current switching apparatus according to claim 1, wherein the permanent magnets are arranged on the central axis.

3. The electric current switching apparatus according to claim 1, wherein the permanent magnets are fixed within the fixed-side electrode unit.

4. The electric current switching apparatus according to claim 3, wherein a gap between adjacent ones of the permanent magnets is located on a side of the movable-side electrode unit in the central axis direction relative to a contact/separation point on the fixed-side contact for the movable contact.

5. The electric current switching apparatus according to claim 3, wherein the fixed-side contact includes a fixed-side main contact, and a fixed-side arcing contact coaxially arranged within the fixed-side main contact, a movable-side arcing contact is provided at an end of the movable contact, and the permanent magnets are fixed within the fixed-side arcing contact.

6. The electric current switching apparatus according to claim 3, wherein the permanent magnets have circular pillar shapes.

7. The electric current switching apparatus according to claim 6, wherein the permanent magnets have a same diameter.

8. The electric current switching apparatus according to claim 3, wherein one of the permanent magnets located nearest to the fixed-side electrode unit has a largest thickness in the central axis direction.

9. The electric current switching apparatus according to claim 1, wherein number of the permanent magnets is two.

10. The electric current switching apparatus according to claim 1, wherein the movable-side electrode unit and the fixed-side electrode unit are provided within a metallic container having insulating gas filled therein.

* * * * *